US007796000B2

(12) United States Patent
Uhm et al.

(10) Patent No.: US 7,796,000 B2
(45) Date of Patent: Sep. 14, 2010

(54) FILTER COUPLED BY CONDUCTIVE PLATES HAVING CURVED SURFACE

(75) Inventors: Man-Seok Uhm, Daejon (KR); Ju-Seop Lee, Daejon (KR); So-Hyeun Yun, Daejon (KR); In-Bok Yom, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 138 days.

(21) Appl. No.: 11/996,770

(22) PCT Filed: Jun. 26, 2006

(86) PCT No.: PCT/KR2006/002457

§ 371 (c)(1),
(2), (4) Date: Jan. 25, 2008

(87) PCT Pub. No.: WO2007/013740

PCT Pub. Date: Feb. 1, 2007

(65) Prior Publication Data

US 2008/0211603 A1 Sep. 4, 2008

(30) Foreign Application Priority Data

Jul. 26, 2005 (KR) ..... 10-2005-0068011
Dec. 15, 2005 (KR) ..... 10-2005-0123773

(51) Int. Cl.
*H01P 1/205* (2006.01)

(52) U.S. Cl. ..... 333/203

(58) Field of Classification Search ..... 333/202, 333/203, 222, 134
See application file for complete search history.

(56) References Cited

U.S. PATENT DOCUMENTS

| | | | | |
|---|---|---|---|---|
| 4,028,652 | A * | 6/1977 | Wakino et al. | 333/209 |
| 4,757,289 | A * | 7/1988 | Kosugi et al. | 333/209 |
| 4,761,624 | A | 8/1988 | Igarashi et al. | |
| 5,808,526 | A | 9/1998 | Kaegebein | |
| 6,377,132 | B1 * | 4/2002 | Wakamatsu et al. | 333/134 |
| 6,664,872 | B2 | 12/2003 | Channabasappa et al. | |
| 2003/0210109 | A1 | 11/2003 | Zhu et al. | |
| 2004/0041661 | A1 * | 3/2004 | Yamakawa et al. | 333/134 |

FOREIGN PATENT DOCUMENTS

| | | |
|---|---|---|
| JP | 60-098702 U | 6/1985 |
| JP | 05167305 | 7/1993 |
| JP | 2002299909 | 10/2002 |

(Continued)

OTHER PUBLICATIONS

International Search Report-Mailed Oct. 10, 2006.

*Primary Examiner*—Benny Lee
(74) *Attorney, Agent, or Firm*—Ladas & Parry LLP

(57) ABSTRACT

Provided is a resonator filter using conductive plates having a curved surface to connect an input/output coaxial connector to a resonator. The resonator filter includes: a plurality of resonators for resonating; an input/output coaxial connector; an input/output supporting unit formed between the input coaxial connector and one of the resonators and/or between an output supporting unit formed between the output coaxial connector and other resonator for electrically and mechanically supporting the input/output coupling; and a connecting unit for connecting the input/output supporting unit and the input/output coaxial connector, wherein the input/output supporting unit is a conductive plate with a curved surface having a center axis similar to the resonators.

5 Claims, 3 Drawing Sheets

FOREIGN PATENT DOCUMENTS

| | | | |
|---|---|---|---|
| JP | 2003110304 | | 4/2003 |
| JP | 2003234601 | | 8/2003 |
| KR | 1999-0022124 | U | 6/1999 |
| KR | 1019990045038 | A | 6/1999 |
| KR | 1019990058995 | A | 7/1999 |

* cited by examiner

[Fig. 1]
(PRIOR ART)
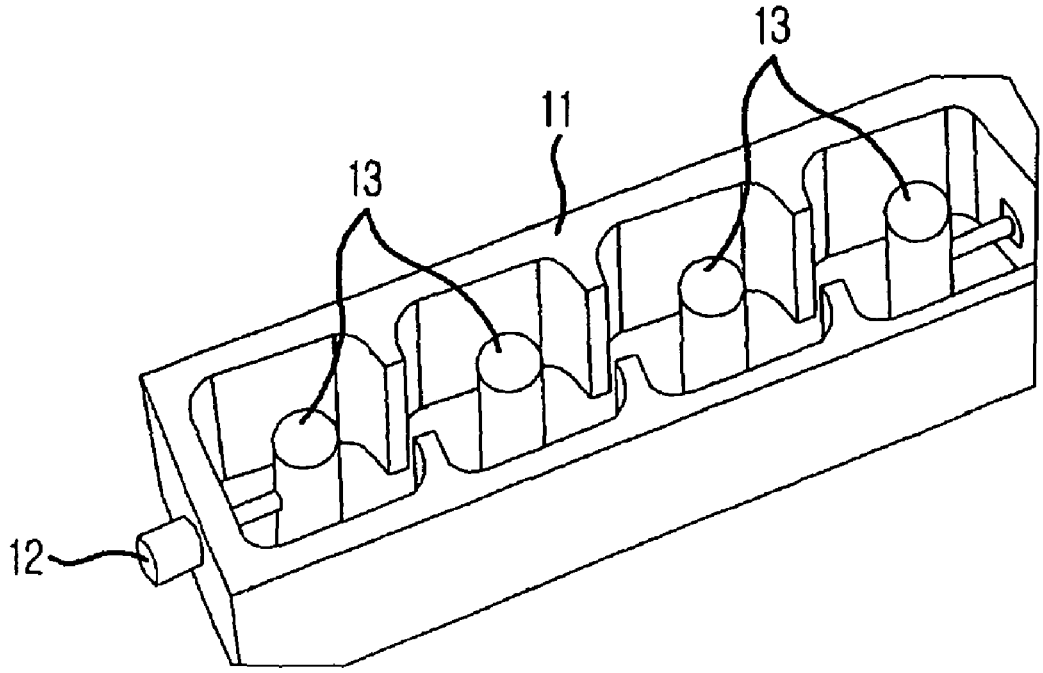
[Fig. 2]
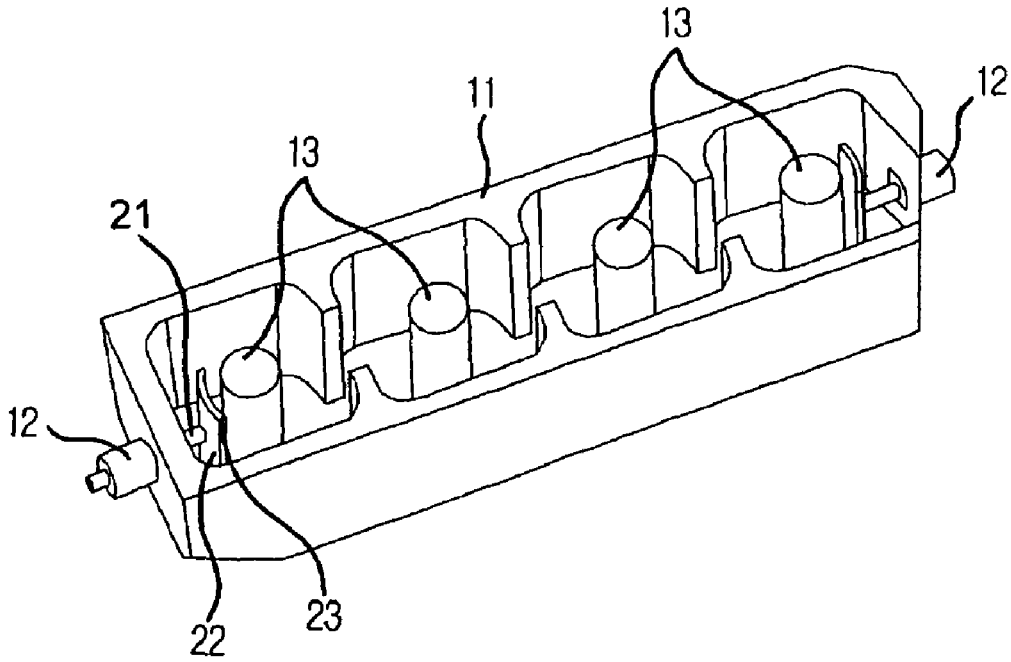

[Fig. 3]
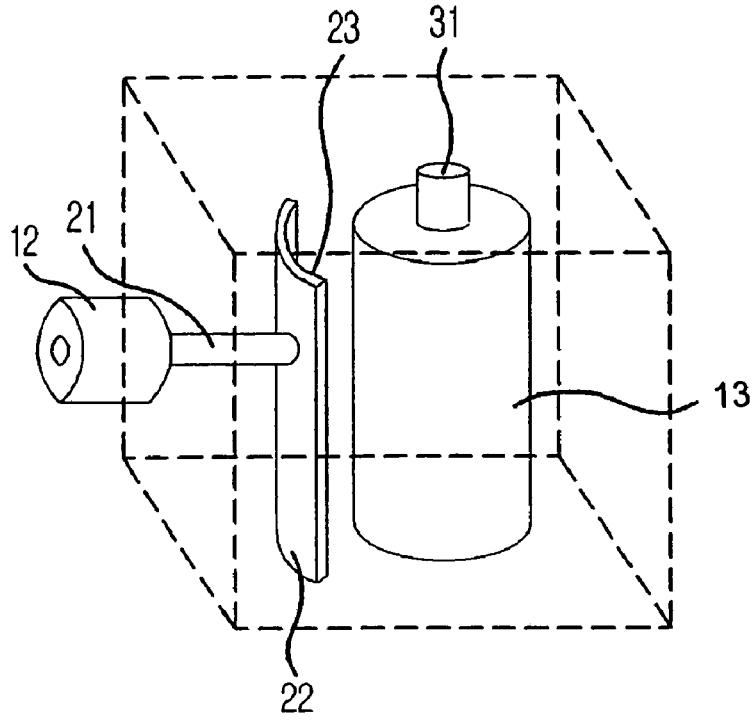
[Fig. 4]
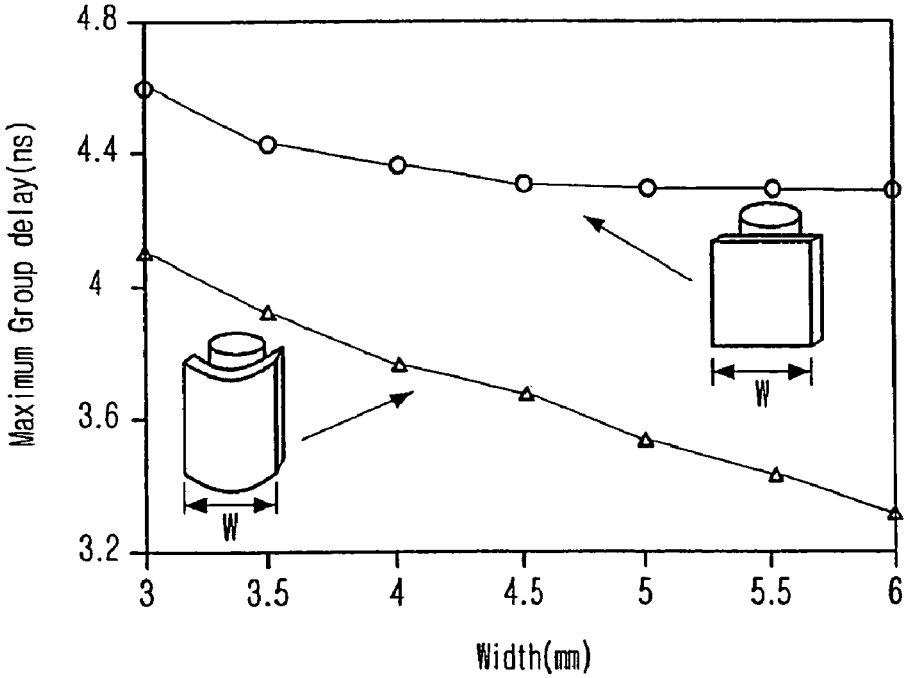

[Fig. 5]
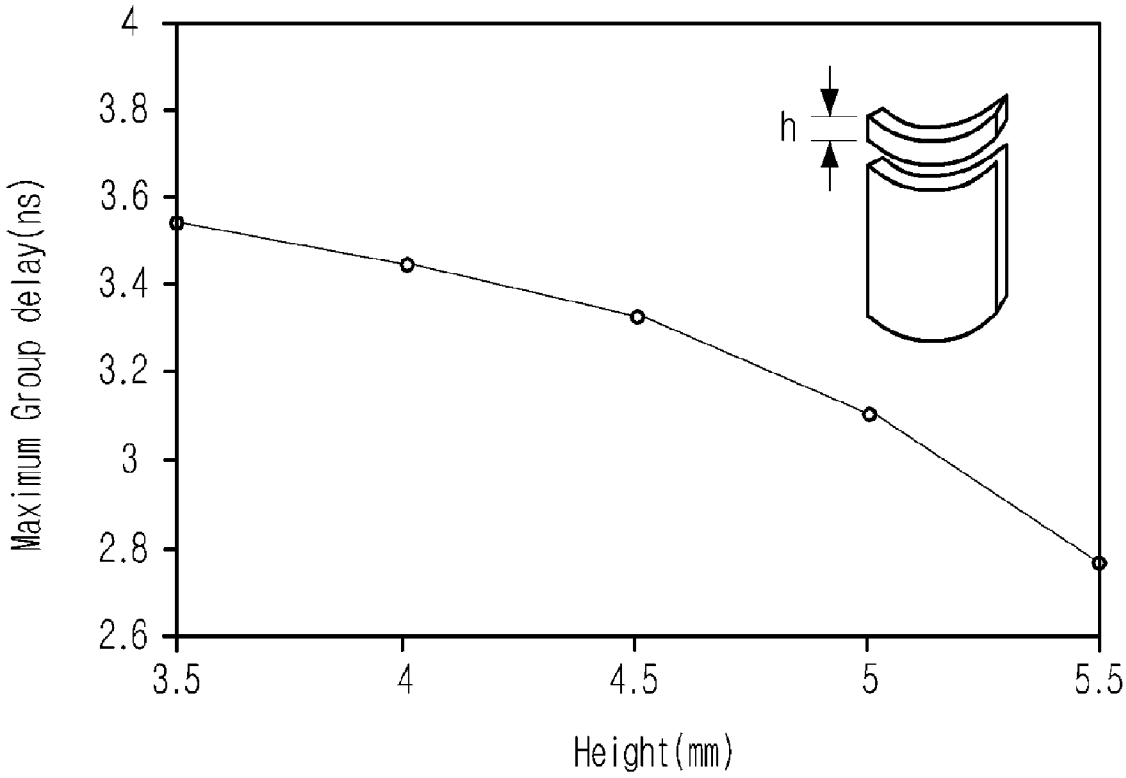

FILTER COUPLED BY CONDUCTIVE PLATES HAVING CURVED SURFACE

TECHNICAL FIELD

The present invention relates to a resonator filter using conductive plates having a curved surface; and more particularly, to a resonator filter using conductive plates, that have curved surfaces, as an input/output connecting member by disposing the conductive plates having a curved surface shaped similar to a resonator at an input or/and an output, connecting the conductive plates with the curved surface to an inside conductive probe (a core probe of a coaxial connector) of an input connector and/or an output connector to increase a coupling amount of an input and/or an output and arranging a supplementary conductive member above the conductive plate to finely tune the coupling amount.

BACKGROUND ART

Hereinafter, a comb-line filter is used as an example to describe a resonator filter coupled with conductive plates that have curved surfaces according to the present invention. The present invention is well-adapted to be used as a filter such as a comb-line filter or as an interdigital filter. However, it is understood that the present invention is not limited to be used only as a comb-line filter.

In order to efficiently use the available frequency spectrum in microwave communications systems, a corresponding frequency band must be divided into a plurality of narrow frequency bands. That is, channelization and multiplexing are required. Therefore, it is essential to develop a filter that satisfies stringent performance criteria for achieving channelization and multiplexing.

As a result, a narrow band filter must have a high frequency selectivity to efficiently use the available frequency resource. Therefore, narrow band filters are often configured as high order filters. Narrow band filters must also function by eliminating any unwanted adjacent harmonic frequency band signal except for the selected signal in pass-band frequencies. Since comb-line filters satisfy these above mentioned characteristics of the narrow band filter, comb-line filters are widely and commonly used as key constituents in wireless communication systems. The comb-line filter according to the related art will be described with reference to FIG. 1 hereinafter.

FIG. 1 is a perspective view of a comb-line filter having resonators connected to an input/output connector in accordance with the conventional art.

As shown in FIG. 1, the conventional comb-line filter includes an input/output coaxial connector 12 for inputting or outputting a signal; a plurality of resonators 13 for resonating; and a housing 11 for housing the comb-line filter.

The conventional comb-line filter generally includes the conductive resonators 13 made of conductors having good electrical conductivity characteristics and are connected together in a side by side manner. Because the comb-line filter is smaller than other types of filters having transmission lines, it is possible to avoid un-wanted harmonic signals that are adjacent to the harmonic frequency band. Generally, comb-line filters include resonators 13, shaped like a rod, in the housing 11 and includes input/output unit 12 which is made of a coaxial connector. The input unit 12 is connected to the first resonator 13 and the output unit 12 is connected to the last resonator 13. The resonators 13 are electrically coupled to one another through an iris (inductive coupling) or through a probe (capacitive coupling).

Although the comb-line filter was introduced during the 1960s, there still exist interest in developing comb-line filters that exhibit superior characteristics to those of more conventional comb-line filters. A considerable amount of research has been focused on reducing the volume of the filter, controlling a coupling amount and controlling a center frequency band.

For example, a first conventional technology was introduced in U.S. Pat. No. 4,761,624 entitled "Microwave band-pass filter." The first conventional technology discloses a dielectric material used instead of an air layer in order to reduce a volume of the comb-line filter that controls the coupling amount by an air space between resonators as shown in FIG. 1. That is, rod shaped holes are formed at a dielectric box, and the hole are filled with dielectric material. The resonators are coupled through a thin conductive strip formed on the dielectric box.

Although the volume of the comb-line filter can be substantially reduced due to using the dielectric material, it is very difficult to finely tune the comb-line filter after manufacturing the filter due to the fixed size of the strip and the space. Accordingly, the adjustable coupling amount is limited by the size of the strip and the space. Such a limitation of designing the filter requires numerous trials and errors to develop a filter part satisfying a target specification. If stringent specifications are required, it is very difficult to manufacture the part to satisfy the specifications. Therefore, a functional part to modify or to control the coupling amount after the manufacturing the filter is often required.

Meanwhile, if irises are inserted between resonators in the filter, a narrow gap is generally required to obtain the requisite coupling amount between the resonators. That is, the filter with the iris generally has a shorter length than a filter without the iris. Therefore, the comb-line filter for the microwave band-pass filter is generally designed to have an iris between the resonators. However, this requires a fine manufacturing process since the size of the iris significantly influences the electrical performance. Also, another drawback is that the manufactured iris cannot be replaced.

In order to overcome these drawbacks, a second conventional technology was introduced in U.S. Pat. No. 6,664,872 entitled "Iris-less comb-line filter with capacitive coupling element. In the second conventional technology, a probe is used as the coupling between the resonators to correct the manufactured iris caused by a mechanical error or a designing error instead of using the iris.

Although the second conventional technology can realize a number of advantages in manufacturing the housing, it is difficult to replace the probe manually. Also, it is impossible to finely tune the second conventional device after manufacturing because the iris coupling uses a tuning screw to fine tune.

Research has continued to actively develop a comb-line filter for an intelligent wireless communication system as a potential next generation wireless communication system, in which it is hoped to be used for a communication system having a fixed center frequency and bandwidth.

The intelligent wireless communication system processes various frequency bands and communication schemes. Such an intelligent wireless communication system must have a function of communicating with other systems within a selected frequency. Therefore, the intelligent wireless communication system requires a filter that tunes a center frequency. In order to achieve this a third conventional technology was introduced in US Patent Publication Application No. 2003/02190109, entitled "Electrically tunable combline filters tuned by tunable dielectric capacitors." In this third conventional technology, a variable dielectric capacitor is coupled to the resonators in the comb-line filter. The variable dielectric capacitor controls a capacitance value by controlling voltage. As a result, the resonance frequency is electrically controlled by changing the capacitance value through voltage, which was controlled using a tuning screw. However, the third conventional technology is distinguished from the present invention because the third conventional technology relates to changing of the resonance frequency and the present invention is related to changing of input/output coupling amount. That is, the third conventional technology allows the resonator to change a center frequency using the variable dielectric capacitor. In contrast, the present invention increases the coupling amount using a support member having curved surfaces similar to the resonator and controls the coupling amount by additionally forming a portion on the support member.

As described above, the first, the second and the third conventional technologies relate to a coupling between resonators, miniaturization and electric-control of resonance frequency in a conventional comb-line filter. However, the input unit and the output unit are directly connected to the resonators and the resonators are separated from one another using a probe supporting member according to the conventional art.

If the input unit and the output unit are directly connected to the resonators, it is difficult to accurately connect the output unit with the resonators. Moreover, the coupling part may be easily separated. Therefore, a careful, precise and accurate process is required.

If a support member is used to couple the probe and the resonator, very narrow spaces must be maintained to obtain maximal coupling because the diameter of the probe is very small. Therefore, it is very difficult to realize such a filter due to these requirements.

In particular, a filter must provide a center frequency and a bandwidth identical to a design value in order to satisfy the strict performance specifications. However, there are no methods that can effectively control a coupling amount of an input unit and an output unit. Until now, a dielectric or a conductive plate was used to control the coupling amount as a supplementary coupling device.

However, it is impossible to control the coupling amount of the input unit and the output unit of the conventional resonator filter made of conductive material, and the conventional resonator filter may be an unstable mechanical structure when the input unit and the output unit are coupled together. Therefore, the coupling of the input unit and the output unit must be improved to develop the resonator filter to satisfy the strict performance specifications. That is, there are great demands to develop a filter capable of controlling a coupling amount of an input unit and an output unit and that has a stable mechanical structure when the input unit and the output unit are coupled together.

SUMMARY OF THE INVENTION

It is, therefore, an object of the present invention to provide a resonator filter using conductive plates having a curved surface as an input/output connecting member by disposing conductive plates having a curved surface shaped similar to a resonator at an input or/and an output, connecting the conductive plates with the curved surface to an inside conductive probe (a core probe of a coaxial connector) of an input connector and/or an output connector to increase a coupling amount of an input and/or an output.

It is another object of the present invention to provide a resonator filter having a supplementary conductive member disposed above the conductive plate with the curved surface to finely tune the coupling amount.

In accordance with one aspect of the present invention, there is provided a resonator filter including: a plurality of resonators for resonating; input and output coaxial connectors; an input/output supporting means formed between the input coaxial connector and one of the resonators and/or between an output supporting means formed between the output coaxial connector and other resonator for electrically and mechanically supporting the input/output coupling; and a connecting means for connecting the input/output supporting means and the input/output coaxial connector, wherein the input/output supporting means is a conductive plate with a curved surface having a center axis similar to the resonators.

The resonator filter may further include a coupling means to be controlled above the input/output supporting means to control an input/output coupling amount.

The resonator filter may further include a tuning screw above the resonators to tune a resonant frequency and frequency response characteristic.

For example, an input/output coupling structure of a comb-line filter is modified according to the present invention to have a wide bandwidth characteristic and to effectively control an input/output coupling amount.

Therefore, a conductive plate with a curved surface similar or identical to a center axis of a rod shaped resonator is disposed in front of a first (and/or a last) resonator in a comb-line filter and the conductive plate is connected to a pin of an input (and/or an output) coaxial connector. Such a coupling structure makes the input/output connector mechanically more stable as compared to a conventional coupling structure that directly connects an input/output connector to a resonator. Also, the coupling structure increases the electrical coupling amount of the input/output unit and allows controlling of the coupling amount by additionally connecting a supplementary conductive member to the conductive plate.

Therefore, the filter using the conductive plate according to the present invention increases the coupling amount as compared to a filter using a probe or a flat conductive plate by disposing the conductive plate with a curved surface having a predetermined length of arc identical or similar to a resonator front (and/or back) of a resonator, connecting an input/output unit to the resonator through the conductive plate. Also, the filter using the conductive plate according to the present invention exhibits a more stable mechanical coupling structure since the input/output connector is connected to the conductive plate in order to be electrically connected to the resonator. Also, the supplementary conductive member is coupled on the conductive plate to control the coupling amount.

A resonator filter according to the present invention includes conductive plates having a curved surface that connect a resonator and an input connector and an output connector to control the coupling amount thereof and to mechanically maintain a stable coupling structure. The resonator filter according to the present invention also includes a coupling controlling conductive member to finely control the coupling amount. Therefore, the resonator filter, made of conductive material, can be developed to satisfy strict performance specifications according to the present invention.

BRIEF DESCRIPTION OF THE DRAWINGS

The above and other objects and features of the present invention will become apparent from the following description of the preferred embodiments given in conjunction with the accompanying drawings, in which:

FIG. 1 is a perspective view of a comb-line filter having resonators coupled with an input/output connector in accordance with the conventional art;

FIG. 2 is a perspective view of a resonator filter having conductive plates having a curved surface in accordance with a preferred embodiment of the present invention;

FIG. 3 is a view showing a resonator filter using conductive plates having a curved surface to connect an input connector and an output connector to resonator in accordance with a preferred embodiment of the present invention;

FIG. 4 is a graph showing coupling amounts of a filter using conductive plates having a curved surface and a filter without conductive plates; and FIG. 5 is a graph showing variation of coupling amount when a coupling controlling conductive member is disposed in a resonator filter having conductive plates having a curved surface in accordance with a preferred embodiment of the present invention.

DETAILED DESCRIPTION OF THE INVENTION

Other objects and aspects of the invention will become apparent from the following description of the embodiments with reference to the accompanying drawings, which is set forth hereinafter.

FIG. 2 is a perspective view of a resonator filter having conductive plates that have curved surfaces in accordance with a preferred embodiment of the present invention.

The resonator filter according to the present invention may be a comb line filter or an interdigitial filter having conductive plates 22 with a curved surface or a rod shaped conductive plates 22, which is connected to a resonator 13 and surrounded by air or dielectric material.

For example, the resonator filter according to the present invention can have a core probe 21 (as shown in FIG. 3) coupled to a conductive plate 22 with a curved surface having a similar shape of the resonator 13 and the conductive plate 22 can have a coupling controlling conductive member 23 additionally connected to the above conductive plate 22. Therefore, the filter according to the present invention provides wide bandwidth characteristics and controls an input/output coupling amount through the input/output coaxial connectors 12.

Referring to FIG. 2, the resonator filter according to the present invention includes: a resonator housing 11; a plurality of resonators 13 in which each resonator 13 has a shape of a rod; an input coaxial connector 12 and an output coaxial connector 12, conductive plates 22 with a curved surface disposed between the input coaxial connector 12 and a first resonators 13 and between the output coaxial connector 12 and a last resonator 13 for electrically and mechanically supporting an input coupling and an output coupling; a core probe 21 for connecting the conductive plates 22 and the input coaxial connector 12 and/or the output coaxial connector 12.

The resonator filter according to the present invention further includes a coupling controlling conductive member 23 formed on the conductive plate 22 to control an input/output coupling amount. Furthermore, the resonator filter according to the present embodiment further includes a tuning screw 31 to finely tune a resonant frequency and a response characteristic of the resonator 13 as shown in FIG. 3.

The conductive plate 22 with a curved surface is an input and/or output coupling conductive plates having a shape of a rod. The conductive plate 22 is directly connected to the core probe 21 of the input coaxial connector 12 and/or the output coaxial connector 12, has a length which is the same or similar to that of the center axis of the resonators 13 and has a predetermined arc. The conductive plate 22 connects the input/output unit to the resonator to mechanically stabilize the input/output units and to increase the electrical coupling amount in the input/output units as compared to the input/output unit directly connected to the resonator.

The coupling controlling conductive member 23 and the conductive plate 22 are joined together using an adhesive, such as an epoxy, or joined together using a bolt. Herein, the tuning screw 31 shown in FIG. 3 controls the resonant frequency of the electric filter. That is, the parallel capacitance value which denotes the coupling amount can be controlled according to a distance between the tuning screw 31 and the resonator 13. As a result, a manufacturing error and a designing error can be corrected.

FIG. 3 is a view showing a resonator filter using conductive plates having a curved surface to connect an input connector and an output connector to resonator in accordance with a preferred embodiment of the present invention.

As shown in FIG. 3, the filter according to the present invention has the input/output coupling structure configured as the input/output coaxial connectors 12, the core probe 21, the conductive plates 22 with the curved surface or the rod shaped, the coupling controlling conductive member 23, the first resonator or the last resonator 13 and the tuning screw 31.

An input reflection coefficient of the input/output coupling structure shown in FIG. 3 can be obtained through estimating an input coupling amount or an output coupling amount using a fine filter analyzing program. Herein, the coupling amount and the resonant frequency are determined in accordance to the group delay characteristics of the obtained reflection coefficient. That is, the greatest value of the group delay characteristics of the reflection coefficient becomes the resonant frequency and the value thereof denote the coupling amount. Since the value thereof is inversely proportional to the coupling amount, the greater value denotes a smaller coupling amount. Likewise, the smaller value denotes the larger coupling amount.

FIG. 4 is a graph showing coupling amounts (maximum group of delays in nanoseconds) of a filter using conductive plates having a curved surface and a filter without conductive plates.

FIG. 4 shows the group delay values in nanoseconds are obtained from the filter having the conductive plate 22 with the curved surface according to the present invention and another filter without the conductive plate with respect to the width (W) in millimeters. As shown in FIG. 4, the filter with the conductive plate having the similar shape of the resonator provides a greater coupling amount as compared to the filter without the conductive plate. Also, the variation amount is also greater so it is convenience to use such characteristics to control the coupling amount.

FIG. 5 is a graph showing variation of coupling amount when a coupling controlling conductive member 23 is disposed in a resonant filter having conductive plates 22 having a curved surface in accordance with a preferred embodiment of the present invention.

FIG. 5 shows coupling amount variation, as defined by maximum group delays in nanoseconds, when the coupling controlling conductive member 23 to be controlled is disposed on the conductive plates. As shown in FIG. 5, the coupling amount is varied according to the height (h) of the coupling controlling conductive member 23 placed above the conductive plate 22. Herein, the coupling controlling conductive member 23 and the conductive plate 22 are coupled through the adhesive such as the epoxy or coupled with the bolt.

The present application contains subject matter related to Korean patent application No. 2005-0068011, and No. 2005-0123773, filed in the Korean Intellectual Property Office on Jul. 26, 2005, and Dec. 15, 2005 the entire contents of which is incorporated herein by reference.

While the present invention has been described with respect to certain preferred embodiments, it will be apparent to those skilled in the art that various changes and modifications may be made without departing from the scope of the invention as defined in the following claims.

The invention claimed is:

1. A resonator filter comprising:

a resonator housing;

a plurality of resonators provided on the resonator housing;

an input/output coaxial connector provided on the resonator housing;

a core probe provided on the coaxial connector;

a conductor plate provided on the core probe wherein the conductor plate has a curved surface that partially surrounds one of the plurality of resonators; and a coupling controlling conductive member provided on the conductor plate to control an input/output coupling amount of the resonator filter.

2. The resonator filter as recited in claim 1, wherein the conductive plate is directly connected to the core probe of the coaxial connector and is arched partially around the one of the plurality of resonators.

3. The resonator filter as recited in claim 1, wherein the resonator filter is one of a comb-line filter or an interdigital filter having the conductive plate with the curved surface surrounded with air or dielectric.

4. The resonator filter as recited in claim 1, further comprising a tuning screw positioned above the one of the plurality of resonators.

5. The resonator filter as recited in claim 4, wherein the tuning screw tunes resonant frequencies and response characteristics of the resonator filter by controlling a capacitance.

* * * * *